US010458410B2

(12) United States Patent
Gao et al.

(10) Patent No.: US 10,458,410 B2
(45) Date of Patent: Oct. 29, 2019

(54) LOW-BACKPRESSURE ROTARY COMPRESSOR

(71) Applicant: GUANGDONG MEIZHI COMPRESSOR CO., LTD., Foshan (CN)

(72) Inventors: Bin Gao, Foshan (CN); Jijiang Yu, Foshan (CN); Hong Guo, Foshan (CN)

(73) Assignee: GUANGDONG MEIZHI COMPRESSOR CO., LTD., Foshan (CN)

( * ) Notice: Subject to any disclaimer, the term of this patent is extended or adjusted under 35 U.S.C. 154(b) by 255 days.

(21) Appl. No.: 15/318,942

(22) PCT Filed: Dec. 4, 2014

(86) PCT No.: PCT/CN2014/093060
§ 371 (c)(1),
(2) Date: Dec. 14, 2016

(87) PCT Pub. No.: WO2016/086396
PCT Pub. Date: Jun. 9, 2016

(65) Prior Publication Data

US 2017/0138360 A1 May 18, 2017

(51) Int. Cl.
*F04C 29/02* (2006.01)
*F01C 21/08* (2006.01)
(Continued)

(52) U.S. Cl.
CPC ..... *F04C 29/026* (2013.01); *F01C 21/0845* (2013.01); *F01C 21/0863* (2013.01);
(Continued)

(58) Field of Classification Search
CPC ..... F04C 29/026; F04C 18/3562; F04C 18/3564; F04C 23/001; F04C 23/008;
(Continued)

(56) References Cited

U.S. PATENT DOCUMENTS 5,242,280 A * 9/1993 Fujio ..... F04C 18/3564 418/11
5,545,021 A 8/1996 Fukuoka et al.
(Continued)

FOREIGN PATENT DOCUMENTS

DE 3528963 A1 3/1987
EP 1806475 A1 7/2007
(Continued)

OTHER PUBLICATIONS

English Translation of WO2014/064974 to Iwasaki et al, Mar. 15, 2018 by Espacenet.*
(Continued)

*Primary Examiner* — Deming Wan
(74) *Attorney, Agent, or Firm* — Osha Liang LLP

(57) ABSTRACT

A low-backpressure rotary compressor includes a shell, a compression mechanism, an oil separator for separating oil and gas from a refrigerant discharged from the cylinder, and an oil pool for collecting a lubricating oil separated by the oil separator. The compression mechanism includes a cylinder assembly, a piston, a sliding vane, main and supplementary bearings. The cylinder has a sliding vane chamber which has an oil supply hole, and a trailing end of the sliding vane stretches into or out of the sliding vane chamber when the sliding vane moves reciprocatingly, such that an interior volume of the sliding vane chamber changes between a maximum volume V2 and a minimum volume V1. The oil pool communicates with the oil supply hole via an oil supply path for the sliding vane, and a ratio of the minimum volume V1 to the maximum volume V2 satisfies the following relationship: 35%≤V1/V2≤85%.

11 Claims, 9 Drawing Sheets

(51) Int. Cl.
*F04C 18/356* (2006.01)
*F04C 23/00* (2006.01)
*F04C 29/12* (2006.01)

(52) U.S. Cl.
CPC ..... *F01C 21/0872* (2013.01); *F04C 18/3562* (2013.01); *F04C 18/3564* (2013.01); *F04C 23/001* (2013.01); *F04C 23/008* (2013.01); *F04C 29/02* (2013.01); *F04C 29/12* (2013.01); *F04C 2210/22* (2013.01); *F04C 2240/30* (2013.01); *F04C 2240/50* (2013.01)

(58) Field of Classification Search
CPC ..... F04C 29/02; F04C 29/12; F01C 21/0845; F01C 21/0863; F01C 21/0872
USPC ..... 418/11, 13, 150, 93, 60, 249, 268–268, 418/DIG. 1
See application file for complete search history.

(56) References Cited

U.S. PATENT DOCUMENTS 7,540,727 B2 6/2009 Byun et al.
7,798,791 B2 9/2010 Byun et al.
2004/0071576 A1* 4/2004 Matsumoto ..... F04C 23/001 418/11
2014/0219845 A1* 8/2014 Hugenroth ..... F01C 21/104 418/1

FOREIGN PATENT DOCUMENTS

JP H0291494 A 3/1990
WO 2012/090345 A1 7/2012
WO 2013/051271 A1 4/2013

OTHER PUBLICATIONS

International Search Report issued in PCT/CN2014/093060 dated Apr. 29, 2015 (2 pages).
Written Opinion of the International Searching Authority issued in PCT/CN2014/093060 dated Apr. 29, 2015 (3 pages).
Office Action issued in corresponding Australian Application No. 2014413252 dated Feb. 24, 2018, and English communication reporting the same (8 pages).

* cited by examiner

LOW-BACKPRESSURE ROTARY COMPRESSOR

FIELD

The present disclosure relates to a field of compressor, and more particularly to a low-backpressure rotary compressor.

BACKGROUND

In a low-backpressure rotary compressor, since an interior space of a shell is configured as a low-pressure suction environment, a gas force applied on a trailing end of a sliding vane is not sufficient to ensure a front end of the sliding vane to closely contact with an outer diameter of a piston, therefore, a zone of the trailing end of the sliding vane needs to be designed as a sliding vane chamber hermetically separated from an inner diameter of the shell, and the sliding vane chamber is provided with a relatively high pressure environment so as to ensure the front end of the sliding vane to closely contact with the outer diameter of the piston. Moreover, as the sliding vane chamber needs to be hermetically separated from the interior space of the shell, a lubrication cannot be realized by using an oil pool in the shell, and thereby it further needs to design a reasonable oil supply path for the sliding vane chamber so as to ensure the lubrication and sealing of the sliding vane.

In addition, in the closed sliding vane chamber, a volume of the sliding vane chamber changes periodically, as the sliding vane moves reciprocatingly. During this change process, when the sliding vane chamber has a minimum volume, a pressure in the sliding vane chamber reaches a maximum value, and when the sliding vane chamber has a maximum volume, the pressure in the sliding vane chamber reaches a minimum value. If a structure volume of the sliding vane chamber is designed unreasonably, when the maximum pressure in the sliding vane chamber is too large, it may appear that the power consumption of the compressor is increased, even that an abnormal large current is resulted in, thus making the electrical motor shut down; when the minimum pressure of the sliding vane chamber is too small, it may also appear that the front end of the sliding vane cannot contact with the outer diameter of the piston closely, such that an impact occurs between the sliding vane and the piston, which generates an abnormal sound and wear and even causing a leakage, thereby deteriorating the performance of the compressor.

SUMMARY

The present disclosure seeks to solve at least one of the problems existing in the related art to at least some extent. For this, the present disclosure provides a low-backpressure rotary compressor, such that a pressure fluctuation of a sliding vane chamber will not be too large or too small.

A low-backpressure rotary compressor according to embodiments of the present disclosure includes: a shell defining an air exhausting port and an air returning port; a compression mechanism disposed within the shell, and comprising: a piston; a cylinder assembly having at least one cylinder, each cylinder being provided with one piston therein and having a sliding vane chamber, the sliding vane chamber being provided with an oil supply hole; a main bearing disposed on a first end surface of the cylinder assembly; a supplementary bearing disposed on a second end surface of the cylinder assembly; and a sliding vane defining a front end abutting against a peripheral wall of the piston and a trailing end, wherein the trailing end of the sliding vane stretches into or out of the sliding vane chamber when the sliding vane moving reciprocatingly, such that an interior volume of the sliding vane chamber changes between a maximum volume V2 and a minimum volume V1; an oil separator configured to separate oil and gas from a refrigerant discharged from the cylinder; and an oil pool configured to collect a lubricating oil separated by the oil separator, and communicating with the oil supply hole via an oil supply path for the sliding vane, wherein a ratio of the minimum volume V1 to the maximum volume V2 satisfies a following relationship: $35\% \leq V1/V2 \leq 85\%$.

With the low-backpressure rotary compressor according to embodiments of the present disclosure, through making the ratio of the minimum volume V1 to the maximum volume V2 satisfy the following relationship: $35\% \leq V1/V2 \leq 85\%$, the pressure fluctuation of the sliding vane chamber will not be too large or too small, so that it is ensured that the sliding vane contacts with the piston closely and hermetically, thereby meeting a force bearing requirement of the sliding vane, and achieving a better performance of the compressor meanwhile.

Preferably, the ratio of the minimum volume V1 to the maximum volume V2 satisfies a following relationship: $50\% \leq V1/V2 \leq 70\%$.

In some embodiments of the present disclosure, a vertical distance between a lowest end of the oil supply hole and a bottom wall of the sliding vane chamber is represented as d, a height of the corresponding cylinder is represented as H, and $0 \leq d \leq \leq 0.8$ H.

Preferably, a ratio of an area S3 of the oil supply hole to the minimum volume V1 of the sliding vane chamber satisfies a following relationship: $0.1 \leq S3/V1 \leq 10.5$.

Further preferably, the ratio of the area S3 of the oil supply hole to the minimum volume V1 of the sliding vane chamber satisfies a following relationship: $2 \leq S3/V1 \leq 6.5$.

In some embodiments of the present disclosure, an area of an inlet of the oil supply path is represented S1, a minimum flow area of the oil supply path is represented as S2, S1, S2 and S3 satisfy following relationships: $S2 \leq S1$, $S2 \leq S3$.

In some embodiments of the present disclosure, the oil supply hole is disposed at a top of the sliding vane chamber, a ratio of an area S3 of the oil supply hole to the minimum volume V1 of the sliding vane chamber satisfies a following relationship: $S3/V1 \geq 4.5$.

In some specific embodiments of the present disclosure, the oil separator is disposed outside of the shell and/or within the compression mechanism.

In some specific embodiments of the present disclosure, the cylinder assembly comprises an upper cylinder, a lower cylinder and a medium clapboard, the medium clapboard is disposed between the upper cylinder and the lower cylinder, a sliding vane chamber of the upper cylinder and a sliding vane chamber of the lower cylinder communicate with the oil pool, respectively.

Further, the sliding vane chamber of the upper cylinder communicates with the sliding vane chamber of the lower cylinder via a medium oil supply path penetrating through the medium clapboard.

Preferably, a first opening area of the medium oil supply path positioned at the sliding vane chamber of the upper cylinder is represented as S4, a second opening area of the medium oil supply path positioned at the sliding vane chamber of the lower cylinder is represented as S5, and $S4 \geq S5$.

REFERENCE NUMERALS

Figure 1:
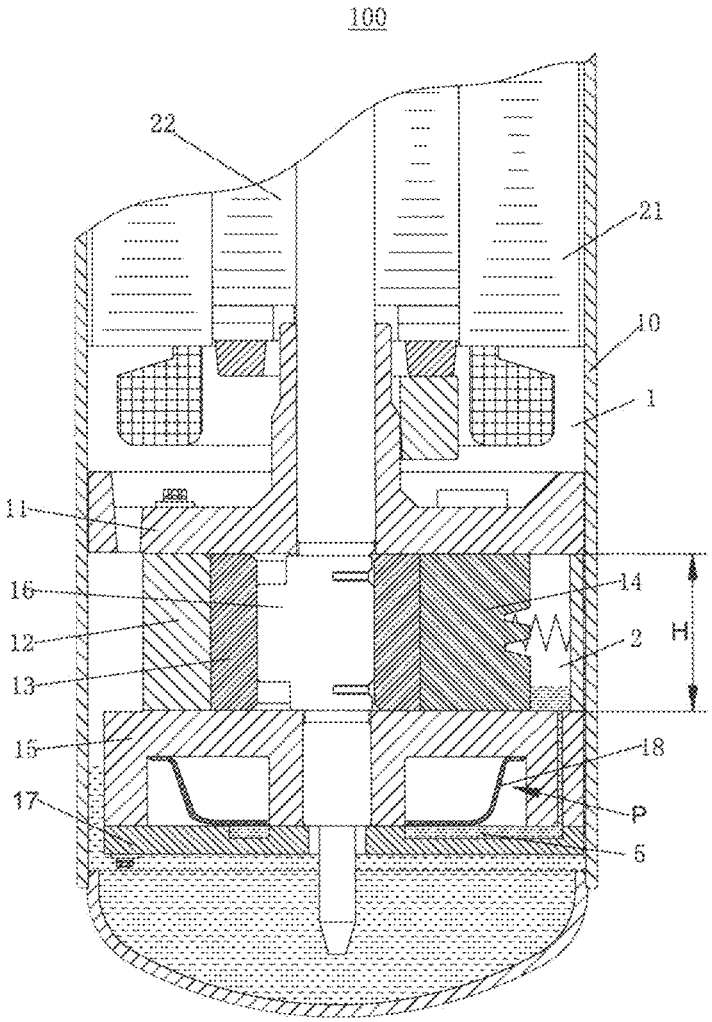
FIG. 1 is a schematic view of a low-backpressure rotary compressor according to an embodiment of the present disclosure, in which the compressor is a single cylinder compressor.

100: low-backpressure rotary compressor; 1: interior space of the shell; 2: sliding vane chamber; 3: oil supply path for sliding vane; 4: sliding vane slot; 5: oil pool; 6: exhausting port; 10: shell; 11: main bearing; 12: cylinder; 13: piston; 14: sliding vane; 15: supplementary bearing; 16: crankshaft; 17: cover plate; 18: oil separator; 21: stator; 22: rotor;

H: height of cylinder; D: distance between oil supply hole of sliding vane chamber and bottom of sliding vane chamber; P: exhausting pressure; P1: minimum pressure in sliding vane chamber; P2: maximum pressure in sliding vane chamber; V1: minimum volume of sliding vane chamber; V2: maximum volume of sliding vane chamber.

DETAILED DESCRIPTION

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," and "counterclockwise" should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the following, a low-backpressure rotary compressor 100 according to embodiments of the present disclosure will be described in detail referring to FIG. 1 to FIG. 9. The low-backpressure rotary compressor 100 may be a single cylinder compressor, and may also be a double cylinder compressor.

As shown in FIG. 1 to FIG. 9, the low-backpressure rotary compressor 100 according to embodiments of the present disclosure includes: a shell 10, a compression mechanism, an oil separator 18 and an oil pool 5. The shell 10 has an air exhausting port 6 and an air returning port (not indicated in figures).

The compression mechanism is disposed within the shell 10, and includes a cylinder assembly, a piston 13, a sliding vane 14, a main bearing 11 and a supplementary bearing 15. The main bearing 11 is disposed on a first end surface of the cylinder assembly, the supplementary bearing 15 is disposed on a second end surface of the cylinder assembly, the cylinder assembly has at least one cylinder 12, each cylinder 12 is provided with one piston 13 therein and has a sliding vane chamber 2, the sliding vane chamber 2 is provided with an oil supply hole, a front end of the sliding vane 14 abuts against a peripheral wall of the piston 13, and a trailing end of the sliding vane 14 stretches into or out of the sliding vane chamber 2 when the sliding vane 14 moves reciprocatingly, such that an interior volume of the sliding vane chamber 2 changes between a maximum volume V2 and a minimum volume V1.

The oil separator 18 is used for separating oil and gas from a refrigerant discharged from the cylinder 12. The oil pool 5 is used for collecting a lubricating oil separated by the oil separator 18. As the refrigerant discharged from the cylinder 12 is a high pressure refrigerant, it can be seen that the oil pool 5 is in a high pressure environment.

The oil pool 5 communicates with the oil supply hole via an oil supply path 3 for the sliding vane, and a ratio of the minimum volume V1 to the maximum volume V2 of the sliding vane chamber satisfies a following relationship: 35%≤V1/V2≤85%. As the sliding vane chamber 2 communicates with the oil pool 5, it can be seen that the sliding vane chamber 2 is in the high pressure environment, thus enabling the front end of the sliding vane 14 to abut against the peripheral wall of the piston 13.

It should be understood that, the low-backpressure rotary compressor 100 further includes an electrical motor, a crankshaft 16, etc. The electrical motor includes a stator 21 and a rotor 22, the stator 21 is fixed at an inner wall of the shell 10 and fitted over the rotor 22, and the rotor 22 is fitted over the crankshaft 16 so as to drive the crankshaft 16 to rotate. The piston 13 of each cylinder 12 is fitted over an eccentric portion of the crankshaft 16, the sliding vane 14 is disposed within a sliding vane slot 4 of the cylinder 12, and the front end of the sliding vane 14 abuts against the peripheral wall of the piston 13 so as to divide the cylinder 12 into a suction chamber and a compression chamber, in which the crankshaft 16 drives the piston 13 to make an eccentric motion in the corresponding cylinder 12, and during the eccentric rotation of the piston 13, the sliding vane 14 moves reciprocatingly within the sliding vane slot 4. When the sliding vane 14 moves reciprocatingly, the trailing end of the sliding vane 14 stretches into or out of the sliding vane chamber 2, and thus the interior volume of the sliding vane chamber 2 also changes periodically along with the reciprocating movement of the sliding vane 14.

Figure 3:
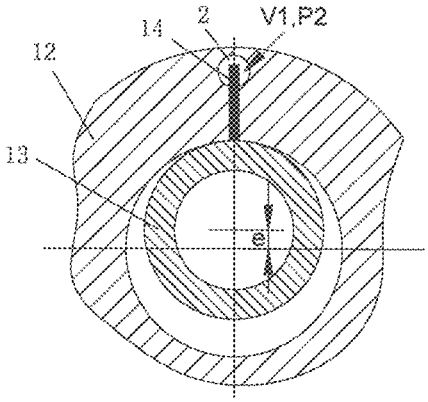
FIG. 3 is a schematic view showing a fitting relationship among a cylinder, a sliding vane and a piston according to an embodiment of the present disclosure, in which an interior volume of a sliding vane chamber reaches a minimum volume.
Figure 4:
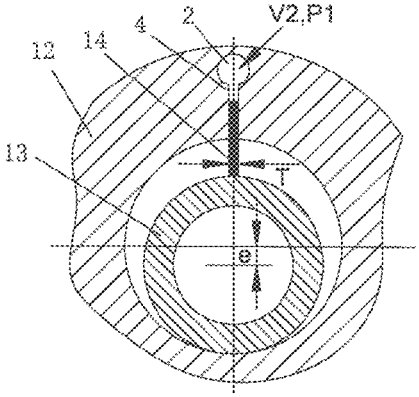
FIG. 4 is a schematic view showing a fitting relationship among a cylinder, a sliding vane and a piston according to an embodiment of the present disclosure, in which the interior volume of a sliding vane chamber reaches a maximum volume.
Figure 10:
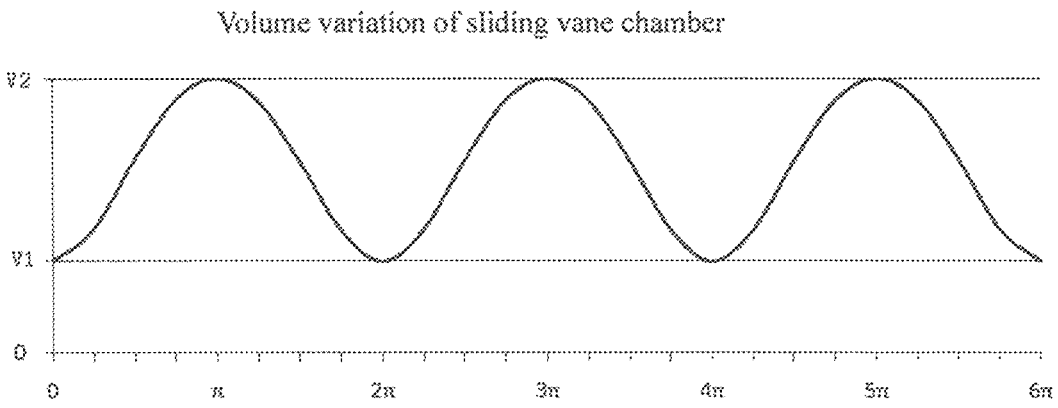
FIG. 10 is a curve diagram showing a volume variation of a sliding vane chamber.

FIG. 10 is a schematic view showing a volume variation of the sliding vane chamber 2 along with the reciprocating movement of the sliding vane 14 during an operation process of the compressor. As shown in FIG. 10, the volume of the sliding vane chamber 2 changes within a range of V1-V2, and the abscissa represents a rotation angle of the piston 13 with respect to a center of the cylinder. As shown in FIG. 3, when the sliding vane 14 is fully received into the sliding vane chamber 2, the rotation angle of the crankshaft 16 is 0 degree, and the volume of the sliding vane chamber 2 reaches the minimum volume V1. As shown in FIG. 4, when the sliding vane 14 stretches out of the sliding vane chamber 2 to the most extent, the rotation angle of the crankshaft 16 is 180 degrees, and the volume of the sliding vane chamber 2 reaches the maximum volume V2. After the crankshaft 16 rotates in one circle, the sliding vane 14 is fully received into the sliding vane chamber 2 again, the rotation angle of the crankshaft 16 is 360 degrees (i.e., 2× radians), and the volume of the sliding vane chamber 2 turns back to the minimum V1. FIG. 10 shows the pressure variation period under an ideal condition, while in an actual compressor, there may be a delay between the pressure fluctuation and the rotation angle of the crankshaft 16 (i.e., the abscissa) due to the influence of the pressure transmission process and the pressure loss, but an attribute of periodic fluctuation variation is unchanged.

According to a working principle of the rotary compressor, as shown in FIG. 3 and FIG. 4, if an eccentric rotation radius of the piston 13 is represented as e, then a maximum stroke of the reciprocating motion of the sliding vane 14 is represented as 2*e*. If a height of the cylinder is represented as H, and a thickness of the sliding vane 14 is represented as T, then there is obtained a following approximate formula:

$$V2=V1+2e*H*T.$$

Figure 11:
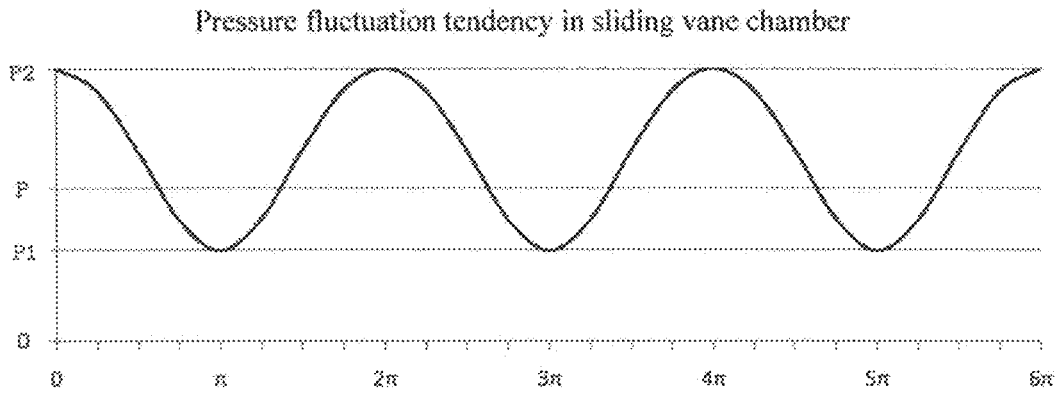
FIG. 11 is a schematic diagram showing a pressure fluctuation tendency of a sliding vane chamber.

With the reciprocating motion of the sliding vane 14, considering that a leakage gap between fitting surfaces of the sliding vane 14 and the cylinder is extremely small, therefore, the interior volume of the sliding vane chamber 2 may be assumed as a closed space, except that the sliding vane chamber 2 communicates with the oil supply path 3 for the sliding vane. In this way, the pressure within the sliding vane chamber 2 will fluctuate along with the volume variation of the sliding vane chamber 2. If the pressure of the inlet (i.e., the oil pool 5) of the oil supply path 3 for the sliding vane is represented as P, the pressure in the sliding vane chamber 2 will fluctuate within a range of P1-P2 along with the volume variation of the sliding vane chamber 2, which is completely different with a traditional high backpressure rotary compressor whose sliding vane chamber is open with respect to the inner space of a shell. Generally speaking, a size of an outlet of the oil supply path 3 for the sliding vane of the sliding vane chamber 2, which outlet is positioned in the sliding vane chamber 2 and configured as the oil supply hole, has a certain effect on this pressure fluctuation. But in general, the pressure fluctuation tendency of the pressure within the sliding vane chamber 2 is shown in FIG. 11. According to FIG. 11, in general, with the reciprocating motion of the sliding vane 14, when the sliding vane chamber 2 has the minimum volume, the pressure therein reaches the maximum value P2, and when the sliding vane chamber 2 has the maximum volume, the pressure therein reaches the minimum value P1, and thus, compared with the oil supply pressure P of the sliding vane chamber 2, there is a relationship P1<P<P2. Similarly, there may be a delay between the pressure fluctuation and the rotation angle of the crankshaft 16, and the pressure fluctuation are mainly affected by the volume variation.

Figure 12:
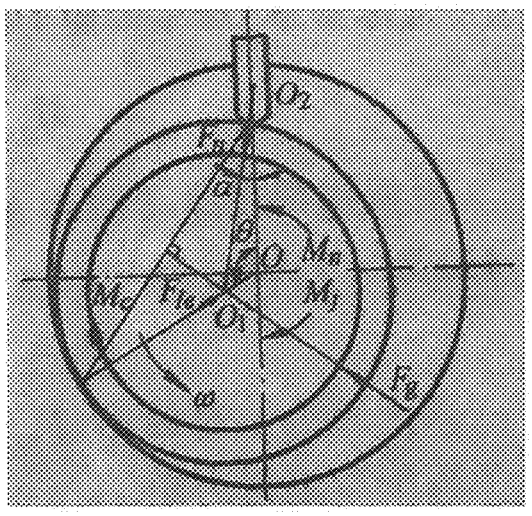
FIG. 12 is a schematic diagram showing a force applied on a crankshaft.

During the operation process of the rotary compressor, the crankshaft 16 rotates under the drive of a rotation torque input by the electrical motor, and a resistance torque M is also applied on the crankshaft 16 in the operation process. The resistance moment M includes several parts, as shown in FIG. 12, and is represented as a following formula:

$$M=Mg+Mn+Mc+Mj,$$

in which,

Mg: a resistance torque produced by a force compressing air;

Mn: a resistance torque produced by a force Fn applied on the outer diameter of the piston 13 by the front end of the sliding vane 14;

Mc: a friction torque produced between the rolling piston 13 and the eccentric crankshaft 16;

Mj: a resistance torque produced between the crankshaft 16 and the main bearing 11, the supplementary bearing 15.

Among these resistance torques, Mn is the resistance torque produced by the force Fn applied on the outer diameter of the piston 13 by the front end of the sliding vane 14, in the low-backpressure rotary compressor, through a force analysis of the sliding vane 14, it is known that a gas force Fc at the trailing end of the sliding vane 14 is one of the important factors affecting the force Fn applied on the outer diameter of the piston 13 by the front end of the sliding vane 14, the greater the gas force Fc at the trailing end of the sliding vane 14 is, the greater the force Fn applied on the outer diameter of the piston 13 by the front end of the sliding vane 14 is. The gas force Fc at the trailing end of the sliding vane 14 is obtained as follows:

$$Fc=Pc*Sc,$$

in which,

Pc: a gas pressure at the trailing end of the sliding vane 14;

Sc: a force bearing area of the trailing end of the sliding vane 14.

In the low-backpressure rotary compressor 100, as the trailing end of the sliding vane 14 is positioned within the sliding vane chamber 2, the gas force Fc at the trailing end of the sliding vane 14 is mainly decided by the gas pressure Pc in the sliding vane chamber 2 in the case of a constant structure. According to the above analysis, it can be seen that, the gas pressure in the sliding vane chamber 2 fluctuates within the range of P1-P2, and thus the gas force Fc at the trailing end of the sliding vane 14 also has a fluctuation.

During the operation process of the rotary compressor, a force applied by the sliding vane 14 to tightly compress the piston 13 needs to be maintained within an appropriate range, so as to avoid an excessive resistance when the force is too large or a leakage and a collision when the force is too small. Therefore, there is also a suitable range for the gas pressure at the trailing end of the sliding vane 14.

As the range of the gas pressure in the sliding vane chamber 2 (i.e. the gas pressure at the trailing end of the sliding vane 14) is mainly affected by the oil supply pressure P and the volume variation range from V1 to V2 of the sliding vane chamber 2, the range of the gas pressure at the trailing end of the sliding vane 14 can be adjusted by adjusting P, V1 and V2.

Figure 13:
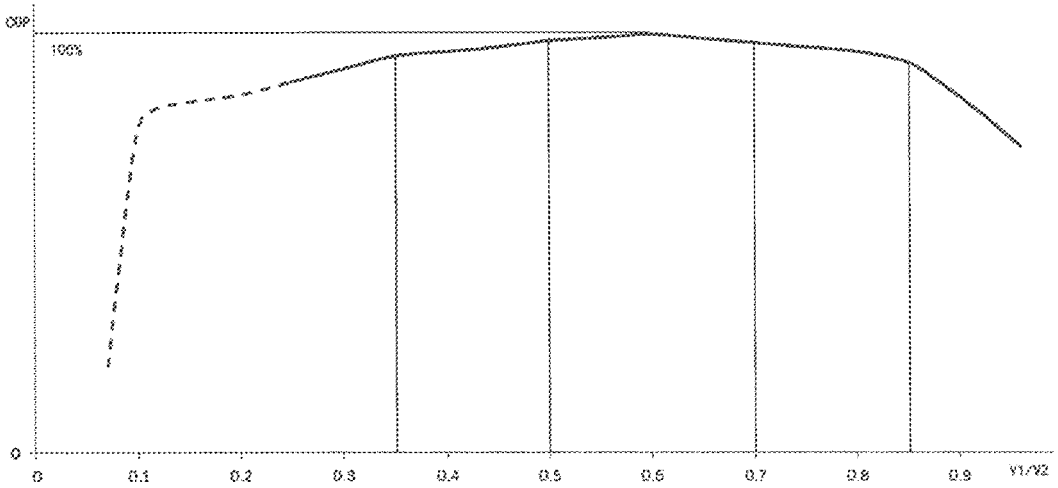
FIG. 13 is a schematic diagram showing a relationship between a ratio of a minimum volume V1 to a maximum volume V2 of the sliding vane chamber and a coefficient of performance of a compressor.

In the case of steady operation, the oil supply pressure P is constant, and therefore the pressure fluctuation may appear in the suitable range of P1-P2 as far as possible through designing a relationship of V1 and V2 in the volume variation range of the sliding vane chamber 2. FIG. 13 shows a relationship between a coefficient of performance (i.e. COP) of the low-backpressure rotary compressor 100 and a ratio of V1 to V2 in the volume variation range of the sliding vane chamber 2, i.e. V1/V2, which is illustrated as follow.

During the operation process of the rotary compressor, if the interior volume V of the sliding vane chamber 2 has the periodical variation range of V1-V2 with the reciprocating movement of the sliding vane 14, in which V1 represents the minimum volume of the sliding vane chamber 2, V2 represents the maximum volume of the sliding vane chamber 2, and thus through a structure design, the relationship between V1 and V2 is set to be:

$0.25\% \leq V1/V2 \leq 95\%$, so that, in most operation conditions of the low-backpressure rotary compressor 100, the force applied on the outer diameter of the piston 13 by the front end of the sliding vane 14 is ensured, so as to guarantee that the sliding vane 14 contacts with the piston 13 closely and will not be separate from the piston 13, thus ensuring the performance and reliability of the compressor. The relationship between V1/V2 and the coefficient of performance (COP) of the low-backpressure rotary compressor 100 is shown in FIG. 13.

If $35\% \leq V1/V2 \leq 85\%$, a suitable force Fn applied on the outer diameter of the piston 13 by the front end of the sliding vane 14 can be obtained, so as to ensure that the compressor can achieve a better performance under most operation conditions, and that the sliding vane 14 contacts with the piston 13 closely and hermetically, because the pressure fluctuation of the sliding vane chamber 2 is not too large or too small at this ratio of the minimum volume to the maximum volume of the sliding vane chamber 2, referring to FIG. 11, i.e. amplitudes of P2 and P1 with respect to P are within a reasonable range, thus better meeting the force bearing requirement of the sliding vane 14 and achieving a better performance of the compressor at the same time.

According to the result in FIG. 13, it can be seen that, if $50\% \leq V1/V2 \leq 70\%$, the performance requirement of the compressor can be better satisfied. Therefore, in preferred embodiments of the present disclosure, the sliding vane chamber 2 is designed in such a manner that the ratio of the minimum volume V1 to the maximum volume V2 satisfies the following relationship: $50\% \leq V1/V2 \leq 70\%$.

In FIG. 13, when V1/V2 is too small, such as $V1/V2 < 20\%$, it is difficult to realize in term of structure due to the processing of the sliding vane chamber 2 and a spring relief hole of the sliding vane 14, and thereby, possible situations are represented by dotted lines in FIG. 13. When V1/V2 is too large, the pressure fluctuation of the sliding vane chamber 2 is small due to the small volume variation of the sliding vane chamber 2, which may cause difficulties in the oil supply of the sliding vane chamber 2, thus deteriorating the lubrication performance and decreasing the COP of the compressor.

Therefore, it can be seen from the above analysis, with the low-backpressure rotary compressor 100 according to embodiments of the present disclosure, the pressure fluctuation of the sliding vane chamber 2 is not too large or too small by making the ratio of the minimum volume V1 to the maximum volume V2 of the sliding vane chamber 2 satisfy the following relationship: $35\% \leq V1/V2 \leq 85\%$, so that it is ensured that the sliding vane 14 contacts with the piston 13 closely and hermetically, thus better meeting the force bearing requirement of the sliding vane 14 and achieving a better performance of the compressor at the same time.

During the volume variation of the sliding vane chamber 2, a state of the oil trapped in the sliding vane chamber 2 may also affect the pressure fluctuation in the sliding vane chamber 2. Because the lubricating oil is a liquid, which belongs to an incompressible product, if the oil trapped in the sliding vane chamber 2 is too much, it needs to overcome a huge resistance to compress the lubricating oil when the sliding vane 14 moves reciprocatingly, thus affecting the performance of the compressor and giving rise to abrasion of the compressor, and even causing the compressor to be shut down during the operation thereof due to an excessive resistance in an extreme situation.

In order to avoid this situation, it is necessary that the lubricating oil in the sliding vane chamber 2 can be reduced appropriately according to an actual situation when the volume of the sliding vane chamber 2 decreases, which can be achieved in the present disclosure by the following solutions.

Solution 1: this solution is most reliable, that is, the oil supply hole of the sliding vane chamber 2 is disposed at the bottom of the sliding vane chamber 2, i.e. a distance d between a lowest end of the oil supply hole and the bottom of the sliding vane chamber 2 is set as: $d=0$.

Solution 2: the oil supply hole is disposed at a middle part of the sliding vane chamber 2, generally considering that a suitable amount of the oil trapped in the sliding vane chamber 2 can improve the lubricating of the sliding vane 14 and the seal of the fitting surfaces; when the sliding vane 14 moves reciprocatingly and the volume of the sliding vane chamber 2 decreases, a part of the lubricating oil in the sliding vane chamber 2 will be left and the lubricating oil will not be completely pressed back into the oil supply hole, and therefore, an opening height d of the oil supply hole of the sliding vane chamber 2 herein is set as: $0 < d \leq 0.8*H$.

In short, the oil supply hole may be disposed at the bottom or the middle part of the sliding vane chamber 2, a vertical distance between the lowest end of the oil supply hole and the bottom wall of the sliding vane chamber 2 is represented as d, the height of the corresponding cylinder 12 is represented as H, and $0 \leq d \leq 0.8$ H.

In addition, the oil trapped in the sliding vane chamber 2 can be recovered and buffered via the oil supply hole, thus avoiding performance and reliability issues of the compressor which are brought by the sliding vane 14 compressing the lubricating oil. Therefore, the size of the oil supply hole may also affect the recycle and buffer of the trapped oil.

A reasonable opening area of the oil supply hole is related to the volume of the sliding vane chamber 2, the recycle and buffer of the trapped oil can be realized by the oil supply hole of the sliding vane chamber 2 and the oil supply path 3 for the sliding vane through the reasonably designed area of the oil supply hole in the sliding vane chamber 2. For the oil supply hole disposed at the bottom or the middle part of the sliding vane chamber 2, in general, if the ratio of the area S3 (unit: $mm^2$) of the oil supply hole to the minimum volume V1 (unit: $cm^3$) of the sliding vane chamber 2 satisfies a following relationship: $0.1 \leq S3/V1 \leq 10.5$, the pressure fluctuation in the sliding vane chamber 2 of the low-backpressure rotary compressor 100 will lie in an acceptable range, thus ensuring the stable and reliable operation of the compressor.

Further, the ratio of the area S3 (unit: $mm^2$) of the oil supply hole to the minimum volume V1 (unit: $cm^3$) of the sliding vane chamber 2 may be designed as: $2 \leq S3/V1 \leq 6.5$.

At last, if the oil supply hole of the sliding vane chamber 2 is disposed at the top of the sliding vane chamber 2, it needs to guarantee the oil supply hole to have a good oil returning performance, and then the ratio of the area S3 (unit: $mm^2$) of the oil supply hole to the minimum volume V1 (unit: $cm^3$) of the sliding vane chamber 2 may be designed as: $S3/V1 \geq 4.5$, thus enabling the area of the oil supply hole to be large enough, compared to the minimum volume V1 of the sliding vane chamber 2.

Figure 2:
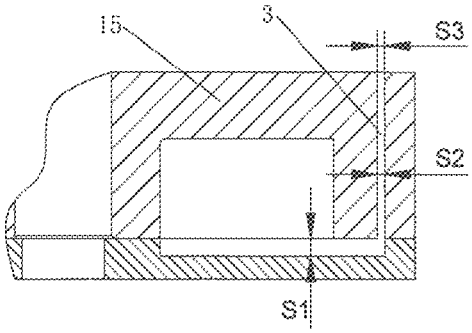
FIG. 2 is a schematic view of an oil supply path for a sliding vane in a supplementary bearing according to an embodiment of the present disclosure.

In addition, as for the oil supply path 3 for the sliding vane, as shown in FIG. 2, if an area of an inlet of the oil supply path 3 for the sliding vane is represented as S1, a minimum flow area of the oil supply path 3 for the sliding vane is represented as S2, and an area of an outlet (i.e. the oil supply hole) of the oil supply path 3 for the sliding vane is represented as S3, when the inlet and outlet are designed to be slightly larger, it is easier for the lubricating oil to be input into and output from the oil supply path, thus ensuring the amount of oil supplied by the oil supply path 3 for the sliding vane to the sliding vane chamber 2 and the effects of recycle and buffer of the oil. That is, the areas of respective parts of the oil supply path 3 for the sliding vane are required to have following relationships: $S2 \leq S1$ and $S2 \leq S3$. When equalities hold, the processing and manufacturing of the oil supply path 3 for the sliding vane can be simplified.

In some embodiments of the present disclosure, the oil separator 18 may be disposed outside of the shell 10 and/or within the compression mechanism. In specific, the oil separator 18 may be disposed as following situations.

Figure 5:
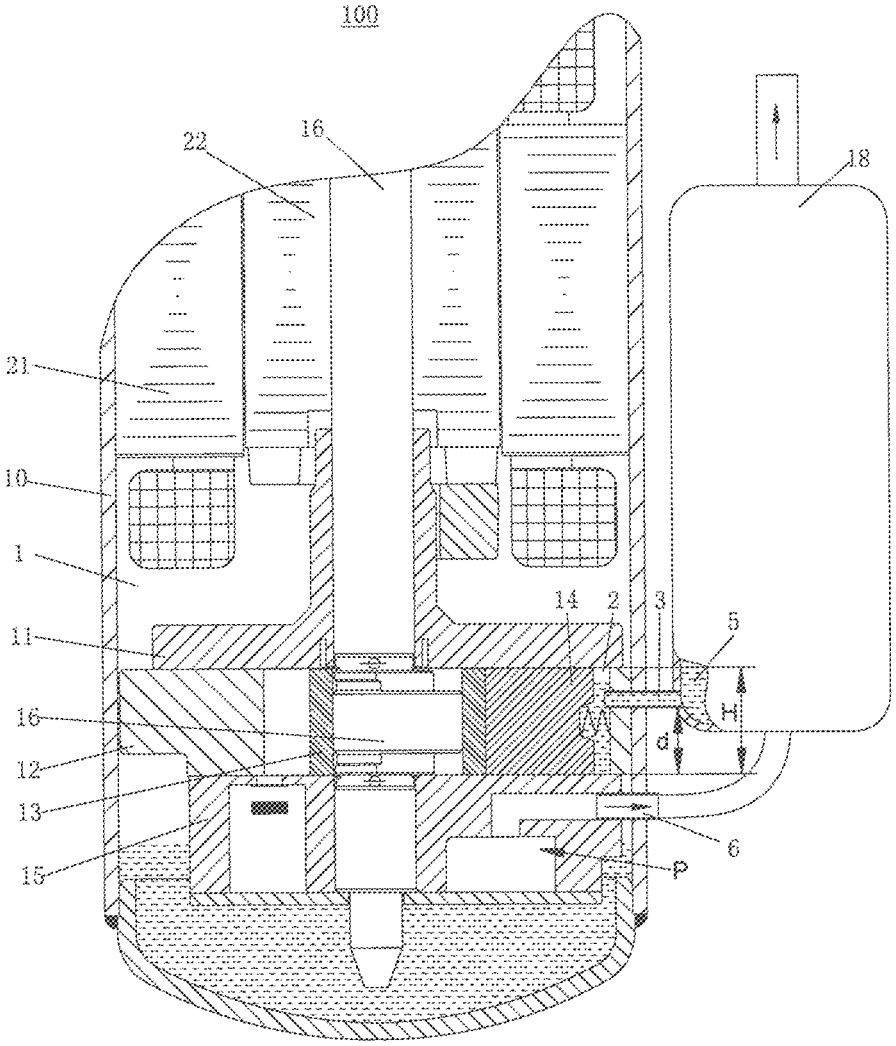
FIG. 5 is a schematic view of a low-backpressure rotary compressor according to another embodiment of the present disclosure, in which the compressor is a single cylinder compressor.
Figure 7:
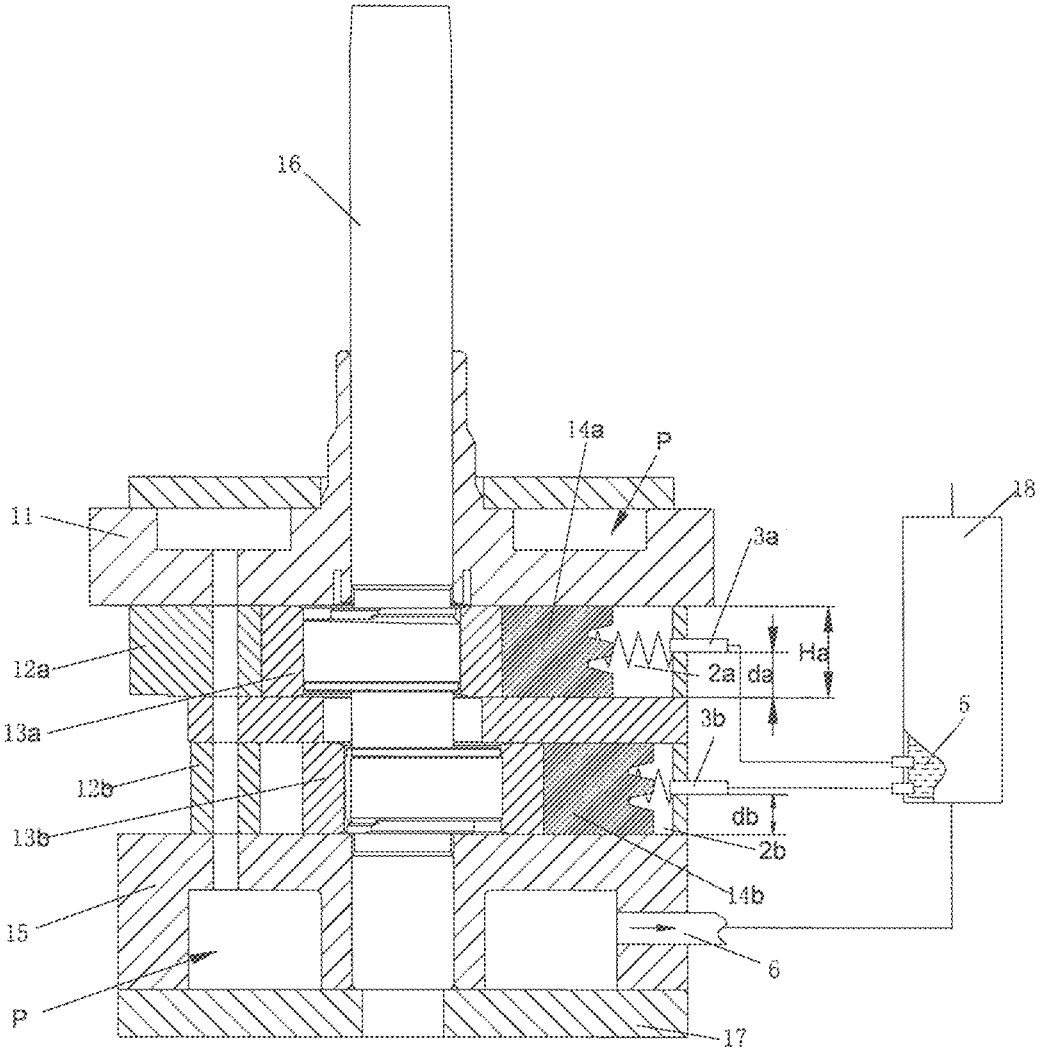
FIG. 7 is a schematic view of a low-backpressure rotary compressor according to another embodiment of the present disclosure, in which the compressor is a double cylinder compressor.

A first situation: as shown in FIG. 5 and FIG. 7, when the low-backpressure rotary compressor 100 is a single or double cylinder compressor, one oil separator 18 is provided and disposed outside of the shell 10, the oil pool 5 is positioned at a bottom of the oil separator 18, the oil separator 18 communicates with an exhausting port 6 of the compressor, and each sliding vane chamber 2 communicates with the oil pool 5.

A second situation: the low-backpressure rotary compressor 100 is a single cylinder compressor, as shown in FIG. 1, the oil supply hole is positioned at the bottom of the sliding vane chamber 2, the oil separator 18 is disposed within an exhausting chamber defined by the supplementary bearing 15 and a cover plate 17.

A third situation: the low-backpressure rotary compressor 100 is a single cylinder compressor, the oil supply hole is positioned at the top of the sliding vane chamber 2, and the oil separator 18 is disposed within the exhausting chamber in the main bearing 11.

A fourth situation: the low-backpressure rotary compressor 100 is a double cylinder compressor, the main bearing 11 and the supplementary bearing 15 are provided with the oil separator 18 and the oil pool 15, respectively.

A fifth situation: the low-backpressure rotary compressor 100 is a double cylinder compressor, a first oil separator and a first oil pool used for collecting the lubricating oil separated by the first oil separator are disposed within the exhausting chamber of the main bearing or the supplementary bearing, a second oil separator is further disposed outside of the shell 10, a second oil pool is provided at a bottom of the second oil separator, the sliding vane chambers of the two cylinders communicate with the first oil pool and second oil pool respectively.

In the following, the low-backpressure rotary compressor 100 according to several different embodiments of the present disclosure will be described in detail referring to FIG. 1, FIG. 5-FIG. 9.

Embodiment 1

As shown in FIG. 1, the low-backpressure rotary compressor 100 according to embodiments of the present disclosure includes: a shell 10, an electrical motor and a compression mechanism. The shell 10 has an interior space 1 communicating with a suction port therein, the electrical motor is disposed in an upper part of the interior space 1 and includes a stator 21 and a rotator 22, and the rotator 22 is connected with the crankshaft 16 so as to drive the crankshaft 16 to rotate.

The compression mechanism includes a cylinder 12, a sliding vane 14 and a piston 13 disposed within the cylinder 12, the crankshaft 16 configured to drive the piston 13 to rotate eccentrically, and a supplementary bearing 15 and a main bearing 11 configured to support the crankshaft 16.

During the operation process of the compressor, the sliding vane 14 moves reciprocatingly along a sliding vane slot 4 disposed in the cylinder 12, and a front end of the sliding vane 14 closely contacts with an outer diameter of the piston 13 to form a compression chamber.

An exhausting chamber is disposed in a lower part of the supplementary bearing 15, and the exhausting chamber is configured as a chamber which is defined by the supplementary bearing 15 and a cover plate 17 fitted with each other and is sealed in pressure with respect to the interior space 1 of the shell, in which a pressure in the exhausting chamber is an exhausting pressure P of the compression mechanism. The oil separator 18 is disposed within the exhausting chamber, and the oil pool 5 is disposed at the bottom of the exhausting chamber for collecting the lubricating oil separated by the oil separator 18 within the exhausting chamber.

A sliding vane chamber 2 sealed and separated in pressure with respect to the interior space 1 of the shell 10 is disposed at a trailing end of the sliding vane 14 and at an outer edge part of the cylinder 12, and the sliding vane chamber 2 has an interior volume V. Moreover, as the sliding vane chamber 2 is sealed and separated in pressure with respect to the interior space 1 of the shell 10, the interior volume V of the sliding vane chamber 2 changes in the range of V1-V2 with the reciprocating movement of the sliding vane 14, in which V1 represents a minimum volume of the sliding vane chamber 2 when the sliding vane 14 is fully received into the sliding vane slot 4, and V2 represents a maximum volume of the sliding vane chamber 2 when the sliding vane 14 stretches out of the sliding vane slot 4 to the most extent.

The minimum volume V1 and the maximum volume V2 of the sliding vane chamber satisfy the following relationship: 35%≤V1/V2≤85%.

Furthermore, the range of V1/V2 may be reduced to a more suitable one as follows: 50%≤V1/V2≤70%.

In addition, as shown in FIG. 1, the low-backpressure rotary compressor 100 is further provided with an oil supply path 3 for the sliding vane, the oil supply path 3 for the sliding vane is disposed in the supplementary bearing 15 and has an inlet communicating with the oil pool 5 in the exhausting chamber. In this embodiment, an outlet (i.e. the oil supply hole of the sliding vane chamber) of the oil supply path 3 is disposed at the bottom of the sliding vane chamber 2, as shown in FIG. 1. As shown in FIG. 2, S1 represents an area of the inlet of the oil supply path 3, S2 represents a minimum cross-sectional area of the oil supply path 3, and S3 represents an area of the outlet (i.e. the oil supply hole).

The ratio of the area S3 (unit: $mm^2$) of the outlet (i.e. the oil supply hole) of the oil supply path 3 for the sliding vane to the minimum volume V1 (unit: $cm^3$) of the sliding vane chamber 2 satisfies a following relationship: 0.1≤S3/V1≤10.5.

Furthermore, the range of S3/V1 may be reduced to another one as follows: 2≤S3/V1≤6.5.

Moreover, the area S1 of the inlet of the oil supply path 3 for the sliding vane, the minimum cross-sectional area S2 of the oil supply path 3, and the area S3 of the outlet of the oil supply path 3 satisfy following relationships: S2≤S1, and S2≤S3.

Embodiment 2

As shown in FIG. 5, in this embodiment, the oil separator 18 of the low-backpressure rotary compressor 100 is disposed outside of the shell 10 and communicates with the exhausting port 6. The oil pool 5 is disposed in the bottom of the oil separator 18, the inlet of the oil supply path 3 for the sliding vane communicates with the oil pool 5 disposed within the oil separator 18, the oil supply path 3 for the sliding vane is configured as an oil supply pipe communicating with the oil pool 5 and the sliding vane chamber 2, and the outlet (i.e. the oil supply hole of the sliding vane chamber 2) of the oil supply path 3 for the sliding vane is positioned at the middle part of the sliding vane chamber 2.

A distance between the oil supply hole and the bottom of the sliding vane chamber 2 is represented as d, a height of the sliding vane chamber 2 is represented as H, and 0<d≤0.8*H.

The remaining parts in this embodiment are the same with those in embodiment 1, and will not be elaborated here.

Embodiment 3

Figure 9:
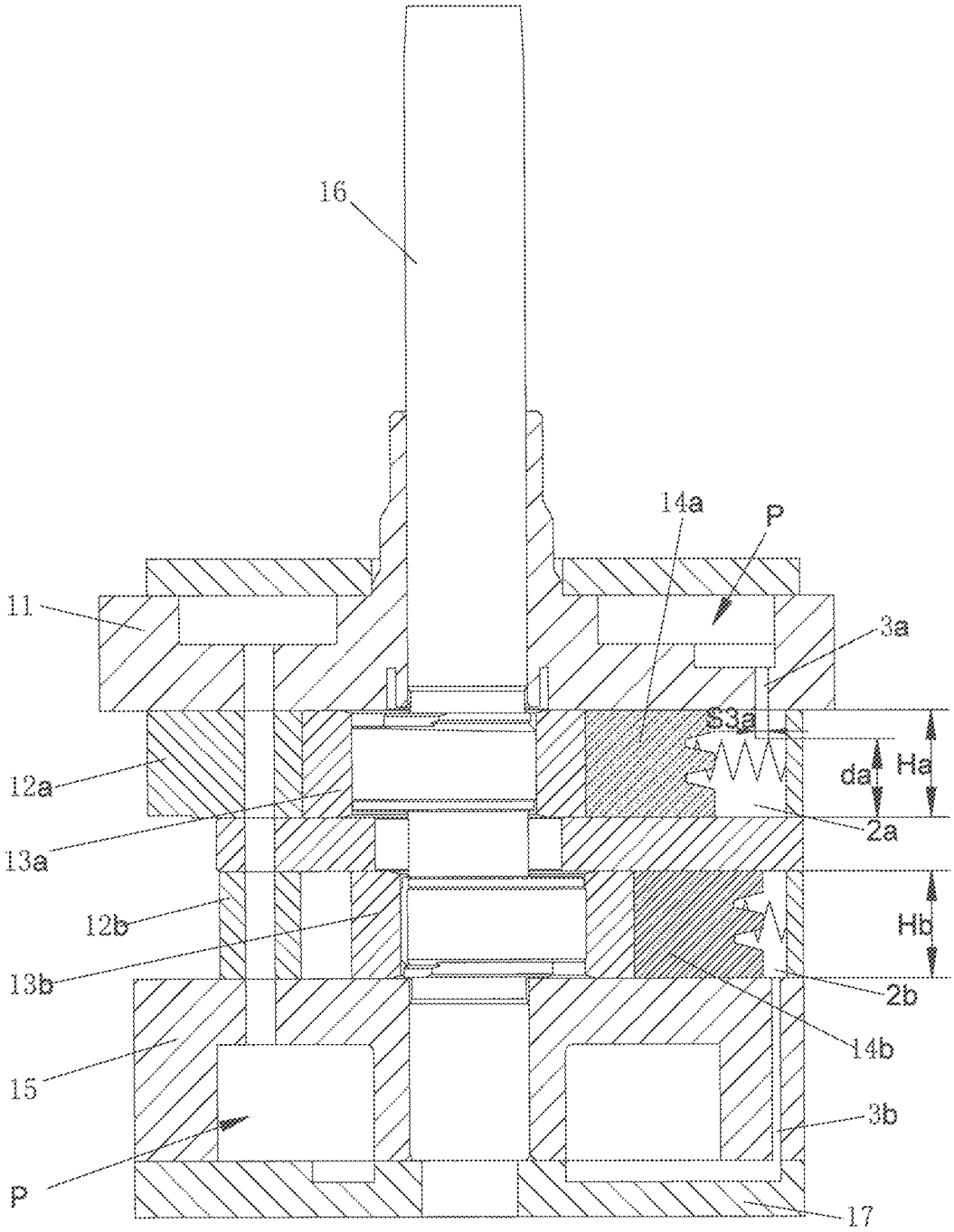
FIG. 9 is a schematic view of a low-backpressure rotary compressor according to another embodiment of the present disclosure, in which the compressor is a double cylinder compressor.

As shown in FIG. 7 and FIG. 9, a difference of this embodiment with embodiment 1 and embodiment 2 lies in that the compression mechanism includes an upper cylinder and a lower cylinder, i.e. the cylinder assembly includes the upper cylinder 12*a*, the lower cylinder 12*b* and a medium clapboard, in which the medium clapboard is disposed between the upper cylinder 12*a* and the lower cylinder 12*b*. Accordingly, the sliding vane chamber 2 also includes an upper sliding vane chamber 2*a* and a lower sliding vane chamber 2*b*, and the upper sliding vane chamber 2*a* of the upper cylinder 12*a* and the lower sliding vane chamber 2*b* of the lower cylinder 12*b* communicate with the oil pool respectively. Moreover, the oil supply path 3 of the sliding vane chamber also includes an upper oil supply path 3*a* and a lower oil supply path 3*b*, . . . .

That is, in this embodiment, the upper cylinder 12*a* and the lower cylinder 12*b* may be respectively analyzed as a single cylinder, the volume V of the sliding vane chamber, the pressure P and the area S3 of the oil supply hole of each cylinder are analyzed corresponding to the structure of the sliding vane chamber of each cylinder, each parameter in the single cylinder is followed by a letter a to represent each parameter of the upper cylinder 12*a*, such as 12*a*, V1*a*, V2*a*, S3*a* and so on, and each parameter in the single cylinder is followed by a letter b to represent each parameter of the lower cylinder 12*b*, such as 12*b*, V2*b*, S3*b*, etc.

Therefore, in this embodiment, the volume of the upper sliding vane chamber of the upper cylinder is in a range of V1*a*-V2*a*, the pressure fluctuates in a range of P1*a*-P2*a*, the area of the inlet of the upper oil supply path 3*a* for the upper sliding vane is represented as S1*a*, the minimum cross-sectional area of the upper oil supply path 3*a* is represented as S2*a*, and the area of the outlet of the upper oil supply path 3*a* is represented as S3*a*, the distance between the upper oil supply hole and the bottom of the upper sliding vane chamber is represented as da, the height of the upper cylinder is represented as Ha, these parameters also satisfy the corresponding relationships described in embodiment 1, for example:

35%≤V1*a*/V2*a*≤85%, further preferably, 50%≤V1*a*/V2*a*≤70%;

0.1S3*a*/V1*a*≤10.5, further preferably, 2≤S3*a*/V1*a*≤6.5;

moreover, S2*a*≤S1*a*, and S2*a*≤S3*a*.

Likewise, parameters and relationships thereof in the lower cylinder are similar to those in the upper cylinder, for example:

35%≤V1*b*/V2*b*≤85%, further preferably, 50%≤V1*b*/V2*b*≤70%;

0.1≤S3*b*/V1*b*≤10.5, further preferably, 2≤S3*b*/V1*b*≤6.5;

moreover, S2*b*≤S1*b*, and S2*b*≤S3*b*.

As shown in FIG. 7, the oil separator 18 is disposed outside of the shell 10, the oil pool 5 is positioned at the bottom of the oil separator 18, the upper oil supply hole of the upper sliding vane chamber 2*a* of the upper cylinder is disposed at the middle part of the upper sliding vane chamber, and the lower oil supply hole of the lower sliding vane chamber 2*b* of the lower cylinder is disposed at the middle part of the lower sliding vane chamber. That is, the outlet of the upper oil supply path 3*a* for the upper sliding vane is positioned at the middle part of the upper sliding vane chamber 2*a* of the upper cylinder, and the outlet of the lower oil supply path 3*b* for the lower sliding vane is positioned at the middle part of the lower sliding vane chamber 2*b* of the lower cylinder. The upper oil supply path 3*a* for the upper sliding vane and the lower oil supply path 3*b* for the lower sliding vane communicate with the oil pool 5, respectively.

As shown in FIG. 9, each of the exhausting chambers of the main bearing 11 and the supplementary bearing 15 is provided with the oil pool therein, the upper oil supply hole of the upper sliding vane chamber 2*a* of the upper cylinder is positioned at the middle part of the upper sliding vane chamber 2*a*, the upper oil supply path 3*a* for the upper sliding vane is configured as an oil supply pipe which communicates with the oil pool in the main bearing 11 and has a lower end stretching into the upper sliding vane chamber 2*a*. The lower oil supply hole of the lower sliding vane chamber 2*b* of the lower cylinder is positioned at the bottom of the lower sliding vane chamber 2*b*.

Embodiment 4

Figure 8:
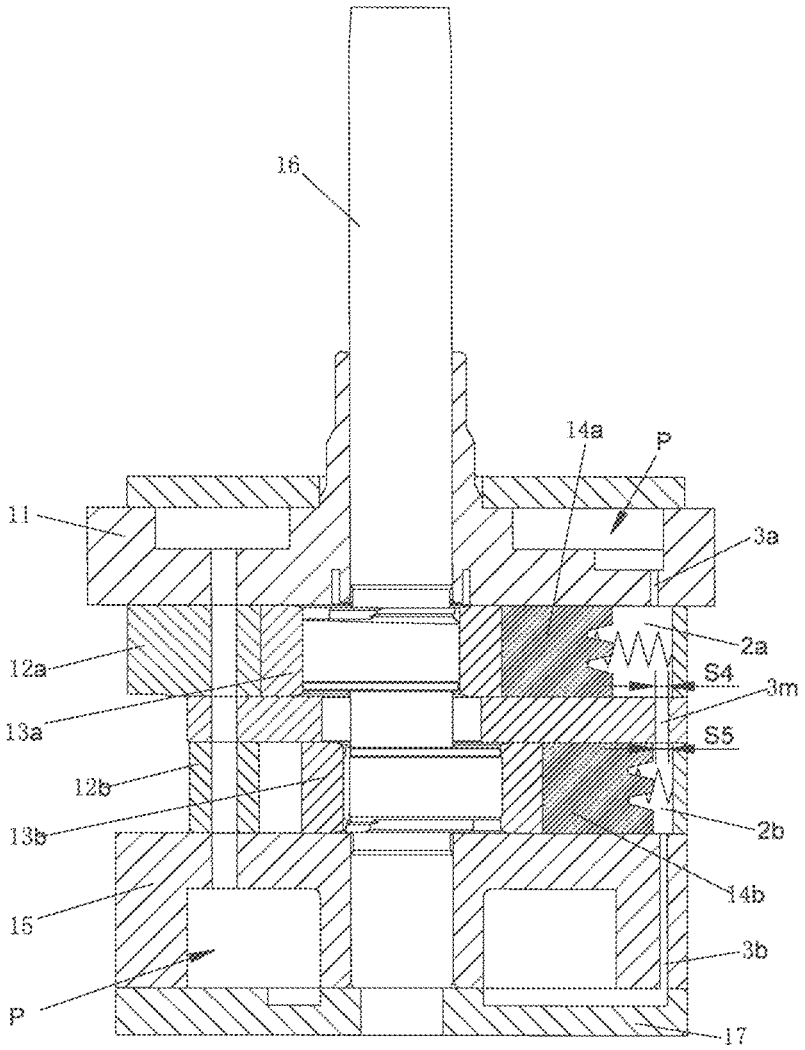
FIG. 8 is a schematic view of a low-backpressure rotary compressor according to another embodiment of the present disclosure, in which the compressor is a double cylinder compressor.

As shown in FIG. 8, the upper oil supply hole of the upper sliding vane chamber 2*a* of the upper cylinder 12*a* is disposed at the top of the upper sliding vane chamber 2*a*, and the lower oil supply hole of the lower sliding vane chamber 2*b* is disposed at the bottom or the middle part of the lower sliding vane chamber 2*b*. At this time, a medium oil supply path 3*m* is disposed between the upper sliding vane chamber 2*a* and the lower sliding vane chamber 2*b*, a first opening area of the medium oil supply path 3*m* in the upper sliding vane chamber 2*a* is represented as S4, a second area of the medium oil supply path 3*m* in the lower sliding vane chamber 2*b* is represented as S5, and S4≥S5. In other words, the upper sliding vane chamber 2*a* of the upper cylinder 12*a* communicates with the lower sliding vane chamber 2*b* of the lower cylinder 12*b* via the medium oil supply path 3*m* penetrating through the medium clapboard, the medium oil supply path 3*m* has the first opening area S4 which is at the upper sliding vane chamber 2*a* of the upper cylinder 12*a*, and the second opening area S5 which is at the lower sliding vane chamber 2*b* of the lower cylinder 12*b*, and S4≥S5.

In this embodiment, the relationship between S4 and S5 is illustrated in following two situations.

First, when the opening area S5 is designed to be small, considering that the pressure buffer effect within the upper sliding vane chamber 2*a* needs to be realized via the medium oil supply path 3*m*, therefore, it is required that S4>S5, so as to ensure that it is easier for the oil in the upper sliding vane chamber 2*a* to enter the medium oil supply path 3*m*, and S5≤3.5 $mm^2$ at this time.

Second, when the opening area S5 is designed to be large, such as S5>3.5 $mm^2$, the opening area S4 may be set to be equal to the opening area S5, i.e. S4=S5.

Meanwhile, in this embodiment, the volume of the upper sliding vane chamber of the upper cylinder is the range of V1*a*-V2*a*, the pressure fluctuates in the range of P1*a*-P2*a*, the area of the inlet of the upper oil supply path 3*a* for the upper sliding vane is represented as S1*a*, the minimum cross-sectional area of the upper oil supply path 3*a* is represented as S2*a*, and the area of the outlet of the upper oil supply path 3*a* is represented as S3*a*, the distance between the upper oil supply hole and the bottom of the upper sliding vane chamber is represented as da, the height of the upper cylinder is represented as Ha, and these parameters also satisfy the corresponding relationships as follows:

35%≤V1*a*/V2*a*≤85%, further preferably, 50%≤V1*a*/V2*a*≤70%;

S3*a*/V1*a*≥4.5;

moreover, S2*a*≤S1*a*, and S2*a*≤S3*a*.

Likewise, parameters and relationships thereof in the lower cylinder are similar to those in the upper cylinder, for example:

35%≤V1*b*/V2*b*≤85%, further preferably, 50%≤V1*b*/V2*b*≤70%;

0.1≤S3*b*/V1*b*≤10.5, further preferably, 2≤S3*b*/V1*b*≤6.5;

moreover, S2*b*≤S1*b*, and S2*b*≤S3*b*.

Embodiment 5

Figure 6:
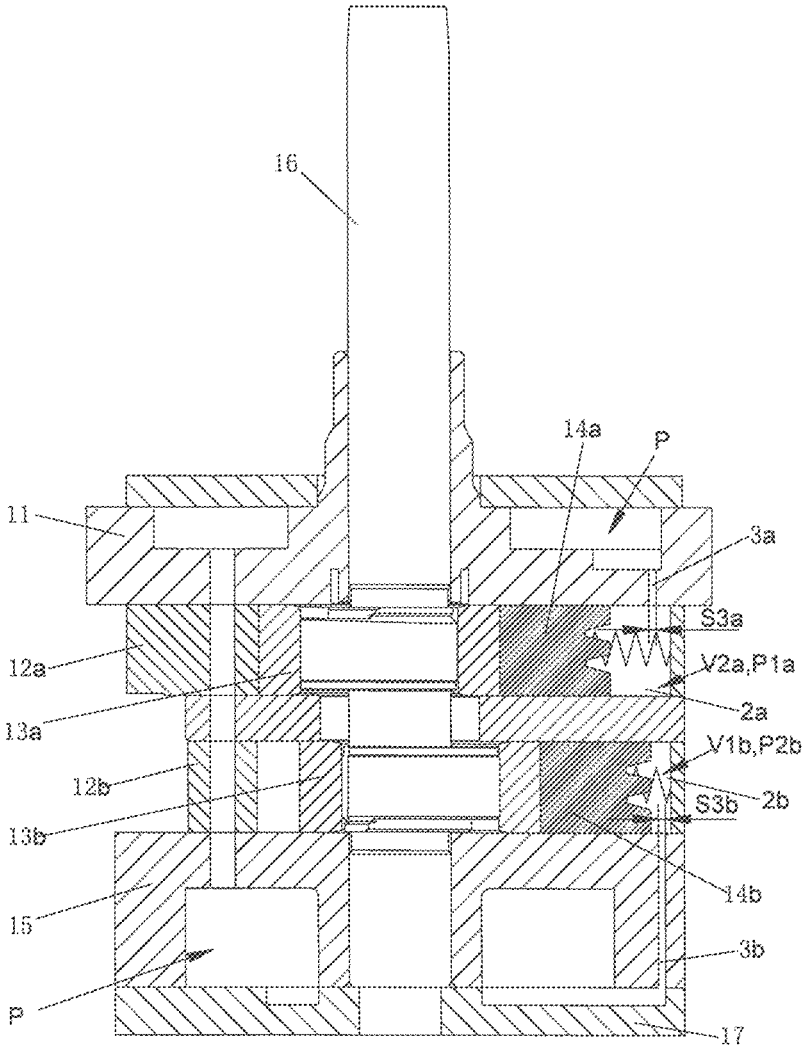
FIG. 6 is a schematic view of a low-backpressure rotary compressor according to an embodiment of the present disclosure, in which the compressor is a double cylinder compressor.

As shown in FIG. 6, a difference of this embodiment with embodiment 4 lies in that no medium oil supply path 3*m* is provided and that the ratio of the area S3*a* (unit: $mm^2$) of the outlet (i.e. the upper oil supply hole) of the upper oil supply path 3*a* of the upper sliding vane chamber 2*a* to the minimum volume V1*a* (unit: $cm^3$) of the upper sliding vane chamber satisfies a following relationship: S3*a*/V1*a*≥4.5.

The remaining parts are the same with those in embodiment 4, and will not be elaborated here.

It should be noted that, the five specific embodiments described above are exemplary illustrations of the low-backpressure rotary compressor 100 of the present disclosure, a connection relationship between the oil supply path 3 for the sliding vane and the sliding vane chamber 2 is not limited to these kinds mentioned above. For example, when the upper sliding vane chamber 2*a* of the upper cylinder 12*a* communicates with the lower sliding vane chamber 2*b* of the lower cylinder 12*b* via the medium oil supply path 3*m*, the oil separator 18 may be disposed outside of the shell 10, the upper oil supply hole of the upper sliding vane chamber 2*a* of the upper cylinder 12*a* is positioned at the middle part of the upper sliding vane chamber 2*a*, and the lower oil supply hole of the lower sliding vane chamber 2*b* of the lower cylinder 12*b* is also positioned at the middle part of the lower sliding vane chamber 2*b*.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A low-backpressure rotary compressor, comprising:

a shell defining an air exhausting port and an air returning port therein;

a compression mechanism disposed within the shell, and comprising:

a piston;

a cylinder assembly having at least one cylinder, each of the at least one cylinder being provided with said piston therein and having a sliding vane chamber, the sliding vane chamber being provided with an oil supply hole;

a main bearing disposed on a first end surface of the cylinder assembly;

a supplementary bearing disposed on a second end surface of the cylinder assembly; and a sliding vane defining a front end abutting against a peripheral wall of the piston and a trailing end, wherein the trailing end of the sliding vane stretches into or out of the sliding vane chamber when the sliding vane moves reciprocatingly, such that an interior volume of the sliding vane chamber changes between a maximum volume V2 and a minimum volume V1;

an oil separator configured to separate oil including lubricating oil and gas from a refrigerant discharged from the at least one cylinder; and an oil pool configured to collect the lubricating oil separated by the oil separator, and communicating with the oil supply hole via an oil supply path for the sliding vane, wherein a ratio of the minimum volume V1 to the maximum volume V2 satisfies a following relationship: $35\% \leq V1/V2 \leq 85\%$.

2. The low-backpressure rotary compressor according to claim 1, wherein the ratio of the minimum volume V1 to the maximum volume V2 satisfies a following relationship: $50\% \leq V1/V2 \leq 70\%$.

3. The low-backpressure rotary compressor according to claim 1, wherein a vertical distance between a lowest end of the oil supply hole and a bottom wall of the sliding vane chamber is represented as d, a height of the corresponding cylinder of the at least one cylinder is represented as H, and $0<d<0.8H$.

4. The low-backpressure rotary compressor according to claim 3, wherein a ratio of an area S3 of the oil supply hole to the minimum volume V1 of the sliding vane chamber satisfies a following relationship: $0.1 \leq S3/V1 \leq 10.5$.

5. The low-backpressure rotary compressor according to claim 4, wherein the ratio of the area S3 of the oil supply hole to the minimum volume V1 of the sliding vane chamber satisfies a following relationship: $2 \leq S3/V1 \leq 6.5$.

6. The low-backpressure rotary compressor according to claim 1, wherein an area of an inlet of the oil supply path is represented as S1, a minimum flow area of the oil supply path is represented as S2, an area of the oil supply hole is represented as S3, S1, S2 and S3 satisfy following relationships: $S2 \leq S1$, $S2 \leq S3$.

7. The low-backpressure rotary compressor according to claim 1, wherein the oil supply hole is disposed at a top of the sliding vane chamber, a ratio of an area S3 of the oil supply hole to the minimum volume V1 of the sliding vane chamber satisfies a following relationship: $S3/V1 \geq 4.5$.

8. The low-backpressure rotary compressor according to claim 1, wherein the oil separator is disposed outside of the shell and/or within the compression mechanism.

9. The low-backpressure rotary compressor according to claim 1, wherein the cylinder assembly comprises an upper cylinder, a lower cylinder and a medium clapboard, the medium clapboard is disposed between the upper cylinder and the lower cylinder, a sliding vane chamber of the upper cylinder and a sliding vane chamber of the lower cylinder communicate with the oil pool, respectively.

10. The low-backpressure rotary compressor according to claim 9, wherein the sliding vane chamber of the upper cylinder communicates with the sliding vane chamber of the lower cylinder via a medium oil supply path penetrating through the medium clapboard.

11. The low-backpressure rotary compressor according to claim 10, wherein a first opening area of the medium oil supply path positioned at the sliding vane chamber of the upper cylinder is represented as S4, a second opening area of the medium oil supply path positioned at the sliding vane chamber of the lower cylinder is represented as S5, and $S4 \geq S5$.

* * * * *